United States Patent [19]

Keeffe et al.

[11] 3,946,262

[45] Mar. 23, 1976

[54] HIGH PRESSURE ELECTRIC DISCHARGE DEVICE WITH HAFNIUM GETTER

[75] Inventors: William M. Keeffe, Rockport, Mass.; Frederic Koury, Alexandria, N.H.

[73] Assignee: GTE Sylvania Incorporated, Danvers, Mass.

[22] Filed: Nov. 22, 1974

[21] Appl. No.: 526,197

[52] U.S. Cl. ..... 313/174; 313/224; 313/229

[51] Int. Cl.[2] ..... H01J 61/24

[58] Field of Search..... 313/174, 176, 178

[56] References Cited

UNITED STATES PATENTS

| | | | |
|---|---|---|---|
| 3,549,937 | 12/1970 | Hanada et al. | 313/178 |
| 3,821,585 | 6/1974 | Jansson et al. | 313/178 |
| 3,829,731 | 8/1974 | T'Jampens et al. | 313/174 |

*Primary Examiner*—R. V. Rolinec
*Assistant Examiner*—Darwin R. Hostetter
*Attorney, Agent, or Firm*—Edward J. Coleman

[57] ABSTRACT

A thin foil of hafnium or a hafnium alloy is disposed within a high pressure metal halide discharge lamp for selectively gettering any hydrogen contaminant within the lamp. In one embodiment a long strip of hafnium foil is welded along the current return wire which extends from the remote end of the arc tube to the base of the lamp, while in another embodiment, bowed-out strips are welded to support straps on each of the arc tube press seals. In this manner, a significant portion of the hafnium getter is disposed in a location where it is subjected to operating temperatures lower than about 330°C.

20 Claims, 3 Drawing Figures

HIGH PRESSURE ELECTRIC DISCHARGE DEVICE WITH HAFNIUM GETTER

BACKGROUND OF THE INVENTION

This invention relates to high pressure electric discharge devices, such as mercury or metal halide arc lamps, and particularly to the means for gettering hydrogen in such lamps.

High pressure discharge devices generally comprise a fused silica arc tube containing a fill of mercury or mercury and metal halides and which is supported by a wire frame within an outer bulbous envelope containing an inert gas such as nitrogen. It is well known that hydrogen contamination is detrimental to the operating of such devices. When trapped in the bulbous envelope, the hydrogen diffuses through the fused silica wall of the arc tube and adversely affects both starting and reignition voltages. The hydrogen migrates into the arc tube and forms, in the case of iodine fills, hydrogen iodide, which is a volatile iodine-containing species and exists as a gas at temperatures even as low as −20°F. At low ambient temperatures the effect of hydrogen contamination is especially noticeable because the presence of the corresponding iodide produces high starting voltages. Moreover, the presence of hydrogen iodide in the arc tube results in a high value of voltages required to reignite the lamp each half cycle of alternating current during the warm-up phase of the lamp operation. This voltage, referred to hereinafter as "reignition voltage," is an important parameter in determining whether a lamp can operate reliably on a given ballast circuit. The lower it is, the more reliable will be operation, or conversely, the more economical will be the ballast design to reach a desired level of reliability.

One of the sources of hydrogen in such devices is the bulbous glass envelope. Ultraviolet light emitted from the arc tube releases hydrogen from hydroxyl radicals which are entrapped in the glass outer envelope.

Getters, that is materials which entrap extraneous gases, have previously been utilized in such devices. Gettering, as usually practiced in the art, involves flashing or volatilizing barium metal to react with gases, thereby removing them from the system. However such procedures not only remove the hydrogen but also getter the nitrogen which is intentionally added. Since an inert gas should generally be present within the envelope, replacement of the nitrogen with argon would be required, as argon is not gettered by barium. But because the use of argon reduces the potential where arcing between elements of the lamp can occur, it is not as satisfactory as nitrogen. Thus, the use of conventional barium getters has serious disadvantages. The same is true of the so-called flashless getters, such as tantalum, cerium, or alloys containing these metals, such as are known to the art. All of these react rapidly with nitrogen as well as hydrogen and would require replacement of the nitrogen fill gas of the outer envelope by argon.

A method of removing hydrogen from the outer envelope, without appreciably effecting the nitrogen content, is described by U.S. Pat. No. 3,519,864, assigned to the assignee of the present application. This patent employs barium peroxide as the getter and disposes the material at a location in the outer envelope where the temperature is normally expected to lie between 150° and 427°C. Within this temperature range, barium peroxide effectively getters hydrogen without significantly reacting with the nitrogen fill gas. The gettering rate at a hydrogen pressure of 30 Torr for 0.7 grams of $BaO_2$ is 25 millitorr-liter/minute at a temperature of 300°C. However at this temperature, the reaction results in an oxygen equilibrium partial pressure of 0.2 millitorr. Such a partial pressure of oxygen is objectionable on several counts. First, nickel platted frame parts begin to show evidence of oxidation after about 100 hours of lamp operation, which could lead to weld failures and presents a generally unsightly appearance. Secondly, the molybdenum arc tube leads show the formation of white cyrstalline form, molybdenum trioxide after about 100 hours which could lead to failure of the hermetic molybdenum ribbon seal resulting in an arc tube leaker. Thirdly, the liberated oxygen may make the identification of outer jacket leakers difficult in manufacture.

In order to effectively getter hydrogen, while reducing the concentration of liberated oxygen and the deleterious affects associated therewith, a getter of barium peroxide and copper has been described for use with high pressure electric discharge devices in U.S. Pat. No. 3,737,710, assigned to the assignee of the present application. A significant disadvantage of the barium peroxide and barium peroxide-copper approaches, however, is that the getter package employed is quite expensive.

A much less expensive gettering means (as little as one tenth the cost of the barium peroxide packages) that has been employed in arc discharge lamps comprises the use of strips of zirconium or zirconium-aluminum, as described, for example, in U.S. Pat. Nos. 2,749,462 and 3,805,105, respectively. However, these zirconium and zirconium alloy getters do not have the high degree of selectivity and hydrogen solubility as the barium peroxide types. Further, these zirconium and zirconium-aluminum strips are very porous and, thus, tend to adsorb contaminants. Hence, oil contamination problems are not uncommon in such zirconium getter lamps.

SUMMARY OF THE INVENTION

In view of the aforementioned shortcomings of the prior art, it is an object of this invention to provide an improved high pressure discharge device having means for effectively gettering hydrogen in a selective manner without producing the deleterious effects associated with the release of the oxygen and without reacting in a deleterious manner with the nitrogen fill gas in the outer envelope.

Another object of the invention is to provide a high pressure metal halide lamp having improved starting, better stabilization of electrical characteristics, improved lumen maintenance, and extended life.

These and other objects, advantages and features are attained, in accordance with the principles of this invention, by using hafnium or any alloy of hafnium in a manner whereby hydrogen is selectively gettered within the lamp envelope. In a high pressure electric discharge device having an arc tube and an outer bulbous envelope, the hafnium is preferably employed as a thin foil disposed within the bulbous envelope but outside the arc tube wherein a significant portion of the hafnium foil getter is subjected to operating temperatures lower than about 330°C.

BRIEF DESCRIPTION OF THE DRAWINGS

The invention will be more fully described in the following detailed description in conjunction with the accompanying drawings, in which.

DESCRIPTION OF THE PREFERRED EMBODIMENT

Figure 3:
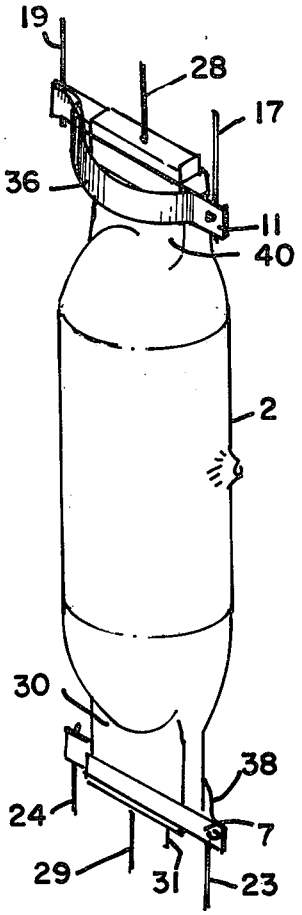
FIG. 3 is a detail view of an arc tube such as that employed in FIG. 1 but illustrating a second getter arrangement in accordance with the invention.

The present invention is particularly useful in relation to high pressure metal halide discharge lamps for providing improved starting, better stabilization of electrical characteristics, improved lumen maintenance, and extended life. These performance improvements are obtained in accordance with the invention, by the incorporation within the lamp of a hafnium selective getter.

The term "selective getter" is used here to mean a material introduced into a lamp for the purpose of reducing or maintaining a sufficiently low partial pressure of contaminant gaseous species, which might otherwise adversely affect the performance of the lamp, without adversely affecting the inert fill gas. The presence of such contaminants may result from one or more of the followng: (1) the lamp may be given a less rigorous exhaust processing during manufacture, inadvertently or to speed up production, thereby leaving residual contaminant gases; (2) gaseous contaminants may be evolved from lamp parts during the operating life of the lamp; or (3) the lamp fill may contain impurity gases.

It is now generally understood by those versed in the art of metal halide discharge lamps that hydrogen is the species responsible for difficult starting, non-sustaining problems (wherein the lamp extinguishes within 30 to 60 seconds following ignition), poor maintenance of luminous output throughout life, and shortened lamp life. This hydrogen originates primarily from the outer bulbous envelope and the iodides present therein and diffuses through the wall of the arc tube, which generally consists of fused silica, although the first possible source of contamination listed in the previous paragraph, namely, incomplete processing, may also obtain on occasion.

As the fused silica arc tube is rather permeable to hydrogen, the hydrogen may be gettered within the outer envelope, though without the arc tube, and yet effectively control the partial pressure of hydrogen in the region of interest within the arc tube. However, since the outer envelope is typically filled with nitrogen to a pressure of about one-half an atmosphere, the conventional types of flashed and flashless getters are not particularly suitable because in addition to hydrogen they also strongly getter nitrogen. Replacing the nitrogen by rare gas unreactive with conventional getters is undesirable because of the lower arc-over potential in rare gases compared with nitrogen. A molecular gas is needed for effective prevention of arc over in the outer bulbous envelope.

We have discovered that hafnium metal or an alloy of hafnium is particularly suitable as a selective getter for hydrogen while not reacting in a deleterious manner with the nitrogen fill in the outer envelope. In addition, the hafnium getter avoids the oxygen liberation problem associated with barium peroxide.

The reaction between hafnium and molecular hydrogen results in the formation of three hydrides: a deformed cubic, a face-centered cubic, and a face-centered-tetragonal phase. The reaction proceeds at sufficiently rapid rates at 50°C and above to remove hydrogen from the outer envelope as fast as it can be generated and diffuse to the getter. A finite reaction rate, even at room temperature, provides gettering action even when the lamp is not operating, which results in improved lamp performance with increased selflife. We furthermore find that the hydrogen hydrides so formed are completely stable at elevated temperatures. The approximate equilibrium partial pressures of hydrogen over the phases at several getter temperatures of interest are:

| Temperature Hf getter | Peq ($H_2$) |
|---|---|
| 158°C | $10^{-7}$ Torr |
| 190°C | $10^{-6}$ Torr |
| 228°C | $10^{-5}$ Torr |
| 272°C | $10^{-4}$ Torr |
| 330°C | $10^{-3}$ Torr |

The above table shows that the temperature at which the hafnium getter is operating controls the equilibrium partial pressure of the hydrogen, which we wish to keep low so as to selectively getter the hydrogen contaminant in an effective manner. Accordingly, a temperature of about 330°C represents the maximum limit desired for selective gettering of the hydrogen, since above this temperature, the equilibrium partial pressure of the hydrogen becomes excessive and thereby substantially diminishes the effectivity of the hafnium in gettering hydrogen. Temperatures below 330°C are attainable in the outer envelope environment of an arc discharge lamp; hence, effective hydrogen gettering may be provided by selective location of the hafnium getter therein.

We have found the preferred form of the hafnium metal to be thin foil, since this presents a large surface area to volume ratio which is conducive to a high specific gettering rate, i.e., the rate of hydride formation per unit volume of hafnium. Of course, there are other approaches for providing large surface area to volume ratios, such as suspending hafnium powder in a binder solution and depositing it on an appropriate surface within the lamp. In general, in order to provide a suitably high gettering rate we prefer a getter material configuration having a surface area to volume ratio which is at least about 16 square centimeters per cubic centimeter.

The preferred quantities of hafnium foil to be used are based on an assumed total molecular hydrogen load to be gettered equal to about 30 Torr of pressure in the outer bublous envelope, which corresponds to approximately $10^{18}$ molecules per cubic centimeter. Based on a solubility limit of 64 atomic percent of hydrogen at the temperatures of interest, we found the quantity of hafnium required for affecting gettering to be at least about 150 milligrams per liter of our envelope volume. Allowing a safety factor of two above this, we determined the preferred quantities for various lamp sizes as follows:

| Standard Lamp Size By Wattage Rating | Quantity of Hafnium Foil |
|---|---|
| 175 Watt | 180 mgs. |
| 400 Watt | 400 mgs. |
| 1000 Watt | 1200 mgs. |

Accordingly, the quantity of hafnium required in standard size high pressure arc discharge lamps is at least about 1 milligram per watt of the power rating of the lamp.

Figure 1:
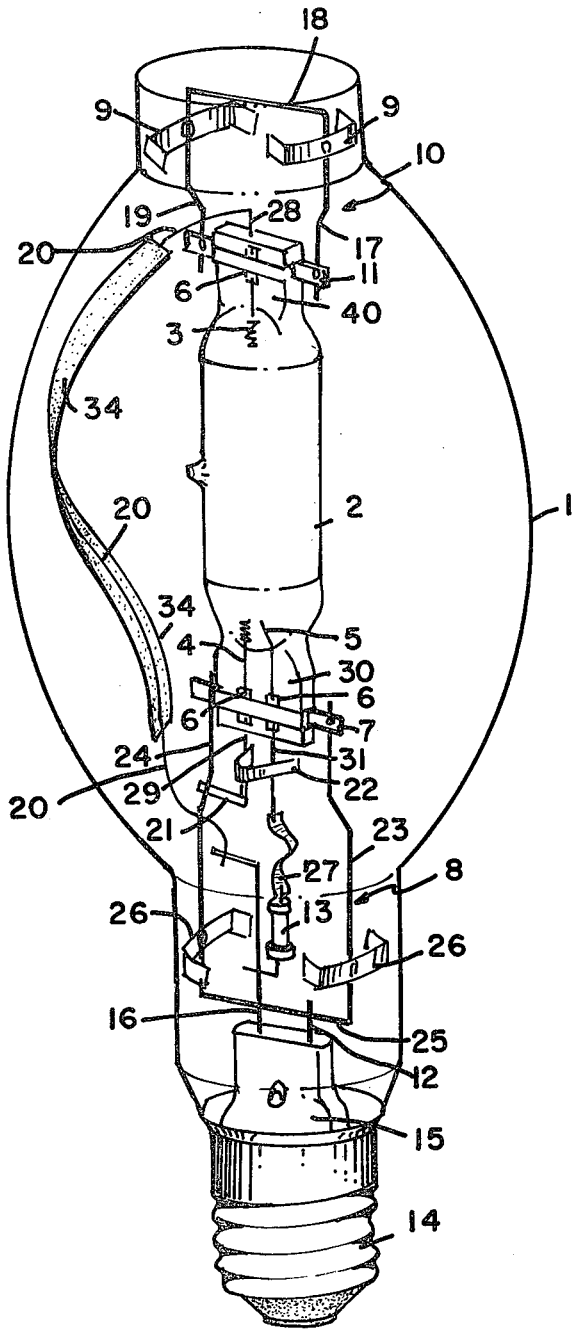
FIG. 1 is an elevational perspective view of a high pressure metal halide discharge lamp having a first getter arrangement in accordance with the invention.

A specific embodiment of a lamp made in accordance with the present invention is shown in FIG. 1. The lamp includes a generally tubular outer bulbous envelope 1 having a bulbous central portion and a conventional base 14 attached to the bottom thereof. Extending inwardly from the base and inside of the envelope 1 is a mount 15 having a pair of stiff inleads 12 and 16 in electrical conducting relation with the base 14. Disposed upon one of the stiff inleads 12 is a lower U-shaped support 8 welded thereto. The U-shaped support 8 comprises a pair of vertical wires 23 and 24 rising from a horizontal base wire 25. The upper ends of the lower U-shaped support 8 are welded together with a lower metal strap 7 which in turn supports a fused silica arc tube 2. Preferably, the lower metal strap includes two sections abutting against either side of the arc tube 2 thereby holding it firmly in place and touching only the press seal 30 of the arc tube and not the body. Generally, both sides of the lower metal strap 7 can be of identical construction. A pair of bumpers 27 are welded to the lower U-shaped support 8 and abut against the tubular portion of the walls of the outer-bulbous envelope 1, thereby stabilizing the structure within the lamp. Preferably, these bumpers are made of a resilient material so that if the lamp is jarred, they will absorb much of the shock.

Since the lower U-shaped support 8 is electrically connected to the stiff inlead 12, the support 8 forms part of the circuit in the device. Current passes from the base 14 to the lower U-shaped support 8 and thence to a lead wire 21 which in turn is connected to an electrode 4 in the arc tube. It is sometimes desirable to place an insulating shield about the lead wire 21 to prevent arcing within the lamp and between the various elements. Current passes from the lead wire 21 to the electrode 4 through an intermediary inlead 29 and molybdenum foil section 6.

The other side of the circuit is formed through the stiff inlead wire 16 which is preferably bent out of place so that the parts on one side of the line are insulated from those on the other side. A resistor 13 is attached to the stiff inlead wire 16 and thence to a connector 27 which in turn leads through an inlead wire 31 and molybdenum foil section 6 to a starting probe 5. A bimetal 22 is attached to the lead-in wire 29 which is connected to the electrode 4. Bimetal 22 is biased open when the device is turned off, but upon starting it biases closed against the inlead wire 31 to the probe 5, thereby establishing the same current potential at the probe 5 and the electrode 4. Such closing prevents electrolysis between the probe and the electrode.

At the other end of the arc tube 2, an upper support 10 is mounted within the tubular portion of the bulbous envelope 1. The support frame 10 includes a horizontal section 18 having vertical supports 17 and 19 depending downwardly therefrom and attached at the free ends to an upper metal strap 11 which surrounds the press seal 40 of arc tube 2 and rigidly holds it in place. Preferably the construction and disposition of upper metal strap 11 is similar to lower strap 7. A pair of upper bumpers 9 are mounted upon the vertical sections 17 and 19 of the upper support 10 and resiliently abut against the sides of the tubular portion of the bulbous envelope 1. Such disposition prevents breakage of the lamp if the arc tube is shaken or dropped.

A inlead wire 28 extends to the outside of the arc tube 2 and is attached at its inner end to a molybdenum foil section 6 and thence to an electrode 3. An electrical connection is made between stiff inlead 16 and inlead 28 through a thin current return wire 20, which may be of any suitable conducting material. Preferably, the conducting wire 20 is distantly spaced from the arc tube 2, generally by bending it around the perimeter of the outer bulbous envelope 1, whereby the wire 20 is curved to extend generally parallel to the inner surface of the bulbous envelope.

The envelope 1 of the lamp is hermetically sealed and filled with nitrogen at a pressure of about half an atmosphere at room temperature to minimize the occurrence of arc-overs between the electrical conductors therein, beneficially affect the temperature distribution over the arc tube 2, and reduce photoelectric current flowing to the arc tube.

In accordance with the invention, a long strip of thin hafnium foil 34 is longitudinally attached, such as by spot welding, to the current return wire 20 as illustrated in FIG. 1. In this manner, the curvature of the foil strip 34 in a bowed out fashion from arc tube 2, as a result of the foil being attached to the curved wire 20, disposes the hafnium getter material in a range of operating temperatures which assures that a significant portion of the getter is disposed at locations along the strip which are subjected to the desired gettering temperatures, i.e. temperatures below 330°C. Spiralling of the wire 20, and thus foil strip 34, also may be helpful to accommodate varying lampmounting orientations.

In one typical embodiment of the lamp of FIG. 1, a strip 34 of one mil hafnium foil (with a 3 percent by weight zirconium impurity) having a width of about 8 millimeters and a length of about 15 centimeters was spot welded to the current return wire 20 in a standard 400 watt size lamp. The outer envelope 1 had a volume of 1.35 liters and was filled with nitrogen to a pressure of 375 Torr. The arc tube contained the following fill ingredients: Sc 0.5 mg; NaI 20 mg; $HgI_2$ 5 mg; Hg 51 mg; and Argon 35 Torr.

Figure 2:
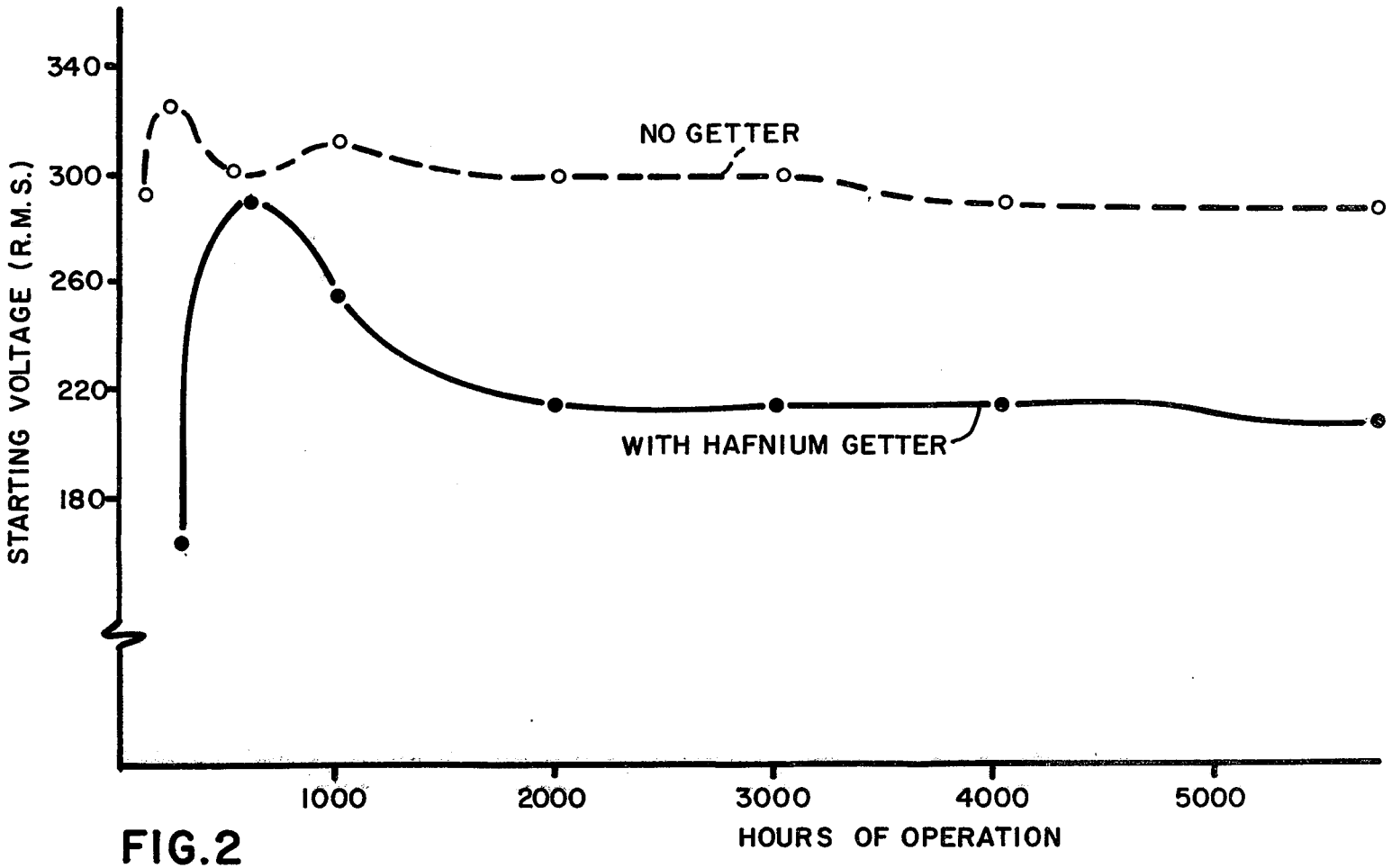
FIG. 2 is a graph of starting voltage as a function of life test operating hours which shows curves for lamps with and without the getter arrangement of FIG. 1.

Lamps of this type were life tested on mercury constant-wattage autotransformer ballasts having an open circuit voltage of 255 volts (rms) and a crest factor of 1.9. The lamps exhibited no starting difficulties throughout 6000 hours of operation. A control group of lamps, not incorporating the hafnium getter, but the same in all other respects, was unable to start on the mercury ballast after 10 to 100 hours operation. These control lamps were then operated on metal halide ballasts for the duration of the life test. Periodically, throughout the test, the starting voltage for both groups was measured. The results of these measurements are shown in FIG. 2. The initial rise in the starting voltage characteristics for the hafnium gettered lamps is indicative of an increase in the hydrogen partial pressure within the arc tube. The subsequent decrease in the curve shows the effect of the hafnium getter in reducing the hydrogen partial pressure. The stabilized starting behavior beyond 2000 hours indicates the equilibrium balance has been achieved between the rate of hydrogen evolution and the gettering rate. The ungettered lamps are seen to require considerably higher voltage to start throughout their life.

FIG. 3 illustrates another embodiment of the invention wherein, in lieu of the hafnium strip attached to current return wire 20, the selective hydrogen getter is incorporated in the outer envelope in the form of a thin foil strip 36 of hafnium which is attached at both ends, such as by spot welding, to the face of the upper metal strap 11 at one end of the arc tube 2. Again, to assure that a significant portion of the getter is disposed in a location subject to operating temperatures lower than about 330°C, the portion of the hafnium strip 36 between the ends thereof is bowed out away from the face of the metal strap 11. A second strip 38 of hafnium getter may be similarly welded to the lower strap 7 on its oppositely disposed face, as illustrated in FIG. 3. By attaching getter strips to both ends of the arc tube in this manner, no need exists for differentiating between attitudes of operation.

Although the invention has been described with respect to specfiic embodiments, it will be appreciated that modifications and changes may be made by those skilled in the art without departing from the true spirit and scope of the invention. For example, it is possible to dispose the hafnium getter within the arc tube 2 to thereby increase the gettering rate, which is limited in the embodiments of FIGS. 1 and 3 by the hydrogen permeation rate through the quartz wall of the arc tube. Further, it is contemplated that the use of hafnium as a selective getter of hydrogen may also be useful in other lamp applications, such as incandescent and fluorescent; in such instances the getter should be disposed in the lamp wherein it is subjected to operating temperatures no higher than about 330°C, and preferably lower than about 300°C.

What we claim is:

1. A lamp comprising: an hermetically sealed envelope; an inert gas in said envelope; electrically energizable means for providing a source of light within said envelope; and means for selectively gettering hydrogen within said envelope, said gettering means comprising hafnium or an alloy thereof.

2. A lamp according to claim 1 wherein a significant portion of said gettering means is disposed in a location in said lamp wherein it is subjected to operating temperatures lower than about 300°C.

3. A lamp according to claim 2 wherein said gettering means comprises a thin foil of hafnium disposed within said envelope.

4. A lamp according to claim 3 wherein said inert gas comprises nitrogen.

5. A lamp according to claim 2 wherein said electrically energizable means comprises means to form an electric discharge within said envelope.

6. A high pressure electric discharge device comprising: a bulbous glass envelope; an arc tube disposed within said bulbous envelope; means to form an electric discharge within said arc tube; and getter means disposed within said bulbous envelope for selectively gettering hydrogen, said getter means comprising hafnium or an alloy thereof.

7. A device according to claim 6 wherein a signficant portion of said getter means is disposed in a location in said device wherein it is subjected to operating temperatures lower than about 330°C.

8. A device according to claim 7 wherein said getter means comprises a thin foil of hafnium disposed within said bulbous glass envelope but outside of said arc tube.

9. A device according to claim 8 wherein said bulbous glass envelope is hermetically sealed and contains an inert gas.

10. A device according to claim 9 wherein the inert fill gas within said bulbous glass envelope but exterior of said arc tube comprises nitrogen.

11. A device according to claim 8 further including a pair of stiff inleads disposed at one end of said bulbous envelope, a lower support mounted on one of said stiff inleads and attached to said arc tube and in electrical connection therewith; an upper support for said arc tube in said bulbous envelope, said upper support being spaced from said lower support and being axially held in the upper portion of said bulbous envelope only by the interposed arc tube; and a wire for conveying current from the other of said stiff inleads to the upper end of said arc tube, said wire being curved to extend generally parallel to the inner surface of said bulbous envelope and distantly spaced from said arc tube; and wherein said thin foil of hafnium is in the form of a long strip longitudinally attached to said wire.

12. A device according to claim 8 wherein said arc tube has press seals at each end; and further including means supporting said arc tube within said envelope including metal straps abutting said press seals at each end of said arc tube; and wherein said thin foil of hafnium is in the form of a strip attached at both ends to the face of one of said metal straps at one end of said arc tube, with the portion of said hafnium strip between the ends thereof being bowed out away from the face of the metal strap to which said strip is attached.

13. A device according to claim 12 wherein a second strip of a thin foil of hafnium is attached at both ends to the face of one of said metal straps at the other end of said arc tube, with the portion of said second hafnium strip between the ends thereof being bowed out away from the face of the metal strap to which said second strip is attached.

14. A device according to claim 8 wherein said arc tube is formed of fused silica and contains a fill of mercury, metal halides and an inert gas.

15. A device according to claim 14 wherein the quantity of hafnium comprising said getter means is at least about 150 milligrams per liter of the volume of said bulbous envelope.

16. A device according to claim 6 wherein said getter means is disposed within said bulbous glass envelope but outside of said arc tube.

17. A device according to claim 16 wherein the material comprising said getter means has a surface area to volume ratio in square centimeters per cubic centimeter of material which is at least about 16.

18. A device according to claim 17 wherein the quantity of hafnium or hafnium alloy comprising said getter means is at least about 150 milligrams per liter of the volume of said bulbous envelope, and a significant portion of said getter means is disposed in a location in said envelope wherein it is subjected to operating temperatures lower than about 330°C.

19. A device according to claim 16 wherein the quantity of hafnium or hafnium alloy comprising said getter means is at least about 150 milligrams per liter of the volume of said bulbous envelope.

20. A device according to claim 19 wherein the quantity of hafnium or hafnium alloy comprising said getter means is at least about 1 milligram per watt of the power rating of said device.

* * * * *